US007705244B2

(12) United States Patent
Fok

(10) Patent No.: US 7,705,244 B2
(45) Date of Patent: Apr. 27, 2010

(54) MULTI-CONDUCTOR CABLE CONSTRUCTION

(75) Inventor: Shung Key Anthony Fok, Quarry Bay (CN)

(73) Assignee: Clipsal Australia Pty Limited, Sydney (AU)

( * ) Notice: Subject to any disclaimer, the term of this patent is extended or adjusted under 35 U.S.C. 154(b) by 0 days.

(21) Appl. No.: 12/291,904

(22) Filed: Nov. 14, 2008

(65) Prior Publication Data

US 2009/0126971 A1 May 21, 2009

(30) Foreign Application Priority Data

Nov. 14, 2007 (HK) ..... 07112445.9

(51) Int. Cl.
*H01B 7/00* (2006.01)

(52) U.S. Cl. ..... 174/113 R; 174/113 AS; 174/113 C

(58) Field of Classification Search ..... 174/110 R, 174/113 R, 113 C, 116, 113 AS, 36
See application file for complete search history.

(56) References Cited

U.S. PATENT DOCUMENTS

| | | | | |
|---|---|---|---|---|
| 1,389,143 | A * | 8/1921 | Kempton | 138/141 |
| 6,150,612 | A | 11/2000 | Grandy et al. | |
| 6,365,836 | B1 * | 4/2002 | Blouin et al. | 174/113 C |
| 6,566,605 | B1 | 5/2003 | Prudhon | |
| 6,639,152 | B2 * | 10/2003 | Glew et al. | 174/113 C |
| 7,173,189 | B1 * | 2/2007 | Hazy et al. | 174/110 R |
| 2007/0044994 | A1 * | 3/2007 | Park et al. | 174/113 C |
| 2007/0163800 | A1 * | 7/2007 | Clark et al. | 174/113 C |

FOREIGN PATENT DOCUMENTS

| | | |
|---|---|---|
| CN | 1624813 A | 6/2005 |
| CN | 200983287 Y | 11/2007 |

* cited by examiner

*Primary Examiner*—William H Mayo, III
(74) *Attorney, Agent, or Firm*—Alix, Yale & Ristas, LLP

(57) ABSTRACT

A cable for use in computer networking for example has a jacket defining an internal space. A separator is located in the internal space and divides the space into three or more segments. The separator has a three or more radiating walls, at least one of which has an extension extending substantially normally from the wall to at least partially enclosed one of the segments. A conductor is located within each segment.

7 Claims, 1 Drawing Sheet

MULTI-CONDUCTOR CABLE CONSTRUCTION

BACKGROUND

The present disclosure relates to electrical cabling of the type that might be used in computer networking for example. The disclosure more particularly, although not exclusively, relates to a multi-conductor cable having reduced crosstalk between adjacent internal conductors.

Ethernet cabling can comprise long runs of twisted pair conductors. Although there is a significant cost advantage in using twisted pair cabling over other types of cabling, crosstalk between adjacent twisted pairs can be a problem—particularly resulting in bandwidth limitations for high-speed networking.

Coaxial cabling and other shielded cabling—whilst displaying superior rejection of crosstalk between adjacent cables is significantly more expensive than twisted pair cabling, is more bulky, more difficult to install and manage (negotiate corners for example) and is more difficult to terminate.

More recent "Cat 6" cabling comprises multiple twisted pairs inside a common jacket. Within the jacket is a cross-shaped internal separator dividing the internal space of the jacket into segments within which respective twisted pairs reside. The separator reduces cross-talk between adjacent internal conductors; however, the known construction still enables a degree of undesirable "Return Loss" and "Near End Cross Talk" between adjacent conductors.

SUMMARY

An improved, cost-effective multi-conductor cable construction provides superior crosstalk rejection between adjacent conductors within the cable.

There is disclosed herein a cable comprising:

a jacket defining an internal space;

a separator located in the internal space and comprising three or more radiating walls dividing the space into three or more segments, at least one of the walls comprises an extension extending substantially normally therefrom to at least partially enclose one of the segments; and a conductor located within each segment.

Preferably, the extension extends approximately half way across a segment.

Preferably, the extension includes an inwardly facing concave surface.

Preferably, the extension extends from one side only of the wall.

Preferably, each conductor is one conductor of a twisted pair.

Preferably, the separator divides the internal space into four quadrants.

Preferably, the separator comprises four radiating walls and wherein each wall of a diametrically opposed pair of said walls includes a said extension.

Preferably, the extension is curved so as to extend substantially tangentially to an inner surface of the jacket.

Preferably, the separator is non-metallic.

BRIEF DESCRIPTION OF THE DRAWINGS

A preferred form will now be described by way of example with reference to FIG. 1 which is a schematic cross-sectional illustration of a cable.

DESCRIPTION OF THE PREFERRED EMBODIMENT

Figure 1:
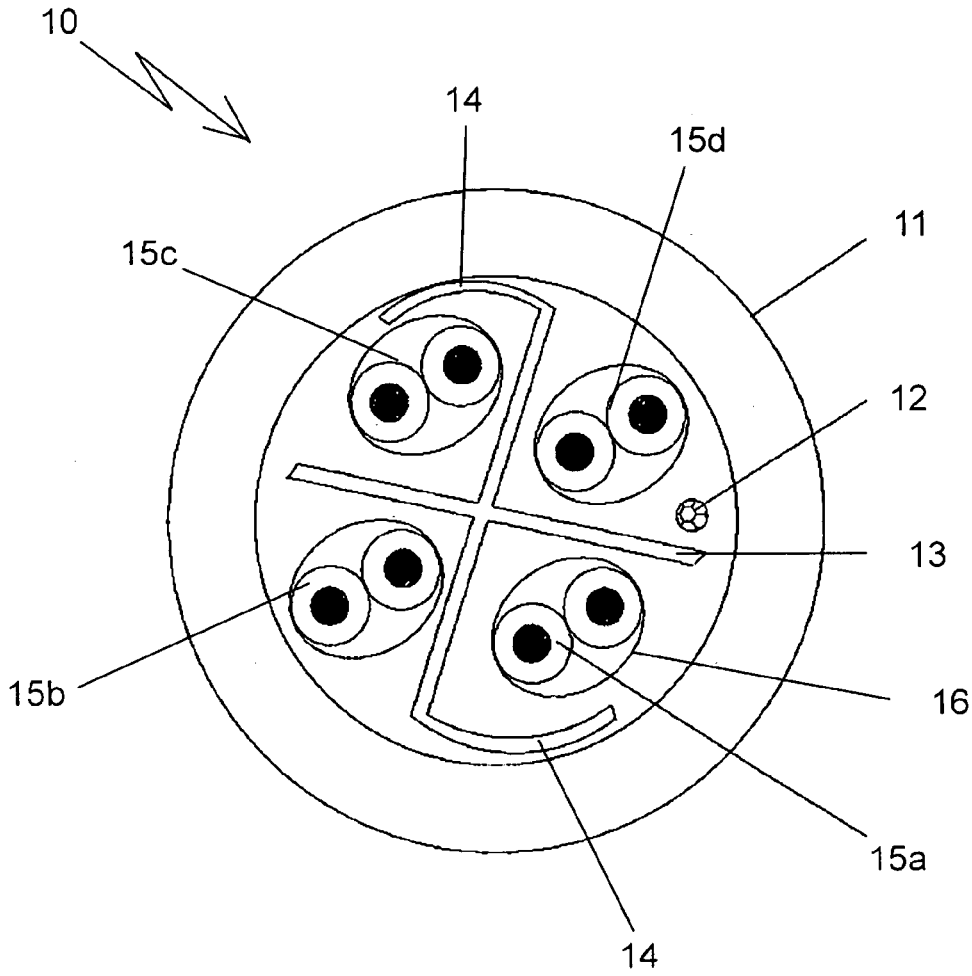

In the accompanying drawing there is depicted schematically a cable 10 comprising a tubular jacket 11 which can be formed of plastics material such as PVC, HDPE or PTFE for example. The tubular jacket 11 defines an internal space within which there is located a non-metallic separator 13. The separator 13 divides the internal space into four quadrants—within each of which there is located a twisted cable pair 15*a*, 15*b*, 15*c* and 15*d*. A ripcord 12 is located close to the jacket in one of the quadrants. The ripcord serves to enable the jacket 11 to be torn open when desired and might also provide tensile strength to the cable 10 to assist in drawing the cable through spaces during installation and provide mechanical strength if the cable is suspended over a long distance between two anchor points, for example.

The separator 13 would typically be made as an extrusion of non-metallic plastics material such as PE or PTFE for example. As seen in the drawing, the separator of the preferred embodiment includes four radially extending walls—two diametrically opposed ones of which have a tangential extension 14 which extends substantially normally from one side of the wall. These diametrically opposed extensions 14 can bear against the internal surface of the jacket 11 to locate the separator 13 substantially centrally therein. The extensions 14 are curved and extend approximately half way across the respective quadrant to partially encase the respective twisted pair 15*a*, 15*c*. The extensions 14 have a concave internal surface which serves to capture the twisted cable pair underneath it.

The extensions increase the effective separation of adjacent twisted pairs and assist in centering the separator within the jacket.

As will be appreciated, the separator 13 provides a degree of physical separation between the twisted pairs in adjacent segments, however the physical separation between the diametrically opposed twisted pairs is greater. That is, the distance between pairs 15*a* and 15*c*, and between pairs 15*b* and 15*d* is greater than the distance between say pair 15*a* and 15*b*, for example. This physical spacing of the twisted pairs is common with certain prior art Cat 6 cables, but as will be appreciated, the prior art cables provide a degree of return loss and near end crosstalk between adjacent twisted pairs which is greater than that between the diametrically opposed twisted pairs as a result of their mutual proximity. The provision in the present invention as exemplified in the preferred embodiment of extensions 14 reduces these undesirable effects between adjacent twisted pairs by extending the physical barrier of the separator. It has been found that the extensions 14 need only extend tangentially from one side of each wall 13.

It is envisaged that the present cable will provide superior headroom for Ethernet, broadband video, 3D imaging and other multimedia applications.

It should be appreciated that modifications and alterations obvious to those skilled in the art are not to be considered as beyond the scope of the present invention. For example, in order to provide shielding in addition to physical separation between the respective twisted pairs of the cable, the separator 13 might be of metal or include metallic particles. Furthermore, the invention is not limited to a separator which divides the jacket space into four quadrants. Two, three, five or more segments might alternatively be provided. Also, each segment need not contain a twisted pair. A single conductor or multi-conductor cable could be located within each segment.

Also, the cable is not limited in its application to computer networking. Indeed it could be used in audiovisual and other applications.

The invention claimed is:

1. A cable comprising:

a jacket defining an internal space;

a separator located in the internal space and comprising three or more radiating walls dividing the space into three or more segments, at least one, but not all, of the walls comprising an extension extending from one side only of the wall substantially normally therefrom and approximately halfway across a segment to at least partially enclose one of the segments; and a conductor located within each segment.

2. The cable of claim 1, wherein the extension includes an inwardly facing concave surface.

3. The cable of claim 1, wherein each conductor is one conductor of a twisted pair.

4. The cable of claim 1, wherein the separator divides the internal space into four quadrants.

5. The cable of claim 4, wherein the separator comprises four radiating walls and wherein each wall of a diametrically opposed pair of said walls includes a said extension.

6. The cable of claim 1, wherein the extension is curved so as to extend substantially tangentially to an inner surface of the jacket.

7. The cable of claim 1, wherein the separator is non-metallic.

* * * * *